United States Patent [19]

Jachowski

[11] Patent Number: 4,667,345

[45] Date of Patent: May 26, 1987

[54] STRAPLESS OUTER GARMENT FOR A WOMAN

[76] Inventor: Ursula Jachowski, Geisenheimer Str. 33, D-6000 Frankfurt 71, Fed. Rep. of Germany

[21] Appl. No.: 833,825

[22] Filed: Feb. 26, 1986

[30] Foreign Application Priority Data

Mar. 4, 1985 [DE] Fed. Rep. of Germany ... 8506164[U]

[51] Int. Cl.[4] ..... A41D 23/00

[52] U.S. Cl. ..... 2/91

[58] Field of Search ..... 2/91, 198, 105, 106, 2/203

[56] References Cited

U.S. PATENT DOCUMENTS

| | | | |
|---|---|---|---|
| 1,002,623 | 9/1911 | Adler | 2/91 |
| 2,575,791 | 11/1951 | Brown | 2/106 |
| 2,806,222 | 9/1957 | Carpenter | 2/91 |
| 3,473,167 | 10/1969 | Jeffrey | 2/106 |

*Primary Examiner*—Doris L. Troutman

*Attorney, Agent, or Firm*—Remy J. VanOphem

[57] ABSTRACT

A strapless top which allows numerous and diverse variations in wearing is achieved by providing a knitted fabric tube member having a circumference in an unstretched condition which is at least half again as large as the maximum chest or bust measurement of the wearer. The knitted fabric tube member is woven such that it is elastic in at least a transverse direction.

6 Claims, 9 Drawing Figures

STRAPLESS OUTER GARMENT FOR A WOMAN

BACKGROUND OF THE INVENTION

1. FIELD OF THE INVENTION

This invention relates to a strapless top for wearing as a woman's outer garment which allows numerous and diverse variations in wearing, thereby considerably increasing the utility of the garment piece.

2. DESCRIPTION OF THE PRIOR ART

Previously known strapless tops permit a minimal number of possible variations and have been limited to a more or less extensive gathering of the material at the top.

SUMMARY OF THE INVENTION

With respect to the invention, the objective of creating a strapless top which allows numerous and diverse variations in wearing is achieved by providing a knitted fabric tube member having a circumference in an unstretched condition which is at least half again as large as the maximum chest or bust measurement of the wearer. The knitted fabric tube member is woven such that it is elastic in at least a transverse direction.

With such a tube member circumference in the unstretched condition it becomes possible, in conjunction with the transverse elasticity of the knitted fabric, after having already wrapped it once around the bust, to double it over or, in many diverse variations, wrap it a second time over one or both of the arms as well as the neck or the nape of the neck to create a strapless outer garment for a woman. Additional wrappings are also possible by further stretching of the knitted fabric tube member, especially in the case of very slender wearers, thus, expanding the extent of variations.

According to one advantageous feature of the present invention, the tube member circumference in an unstretched condition is, however, smaller than double the bust measurement of the wearer, which still assures an adequately tight fit even with a double wrapping. The tightness of the fit can be increased further, according to a further feature of the invention, by providing one of the two tube member edges with an additional elastic piece, which can be efficiently realized by chain-stitching an elastic cord in one of the tube member edges.

The invention is described in more detail below with the aid of the drawings.

DETAILED DESCRIPTION OF THE PREFERRED EMBODIMENT

Figure 1:
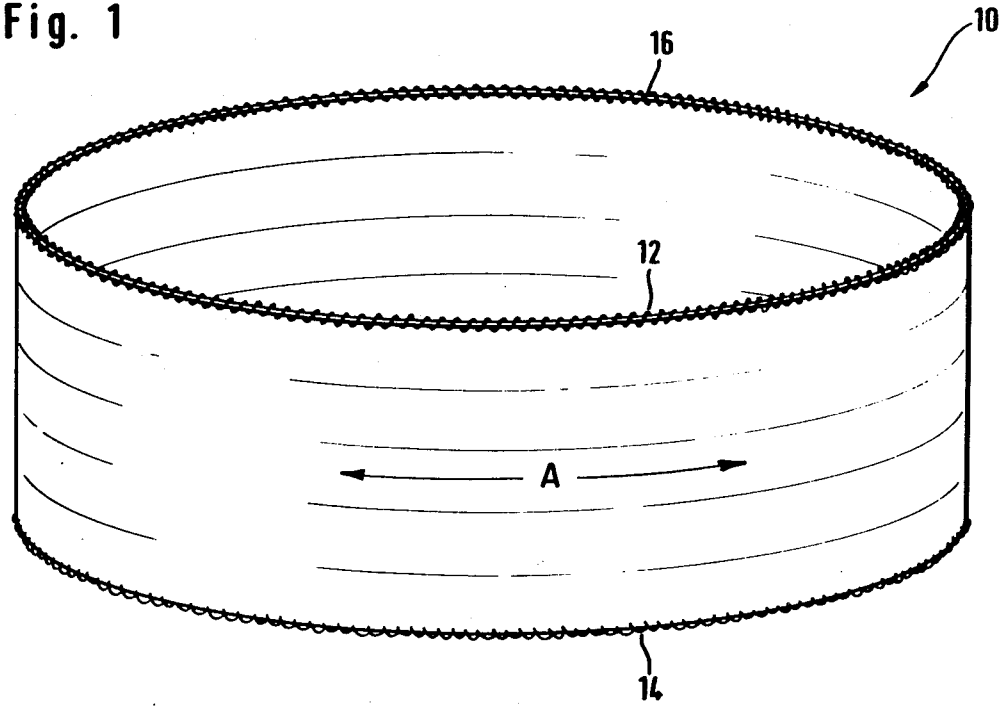
FIG. 1 is a perspective schematic drawing of a woman's strapless outer garment in an unstretched condition constructed according to the teachings of the invention.

FIG. 1 illustrates a strapless top 10 according to the present invention consisting of the tube member having a relatively short tubular width of knitted fabric which is elastic in at least the transverse direction as shown by double arrow A. The material can be either a single thread weft or multiple of chain or wrap knitted fabric which is bound on upper and lower edges 12 and 14, respectively, to prevent unwanted opening of the loops. The material in question is generally of a synthetic composition, alternatively mixed with cotton.

The fabric width is constant all around the circumferential length of the tube member, and the circumference of the tube member is at least 1.5 times the bust measurement of the wearer, i.e., approximately 120–130 cm, in the preferred embodiment, understanding that this will vary depending on the size of the wearer, with the transverse elasticity being sufficiently great to allow the fabric to be expanded to more than twice the bust measurement in order to allow it to be slipped over the upper portion of a wearer's body. On the other hand, the circumference of the tube member in an unstretched condition should not exceed twice the bust measurement, so as to be able to wear it over the upper torso without it slipping down.

In order to assure a tight fit on the upper torso, especially in the event of a stretching of the tube member material when worn, an elastic cord 16 is chain-stitched into the upper edge 12.

In the alternative, instead of an elastic cord, an elastic band, not illustrated, may be used which, if necessary, may be subsequently hemmed into the strapless top 10 with a zig-zag stitch along one or both of the upper and lower edges 12 and 14.

FIGS. 2 through 9 show various forms of usage of the top depicted in FIG. 1, with not all possible applications being exhaustively treated.

Figure 4:
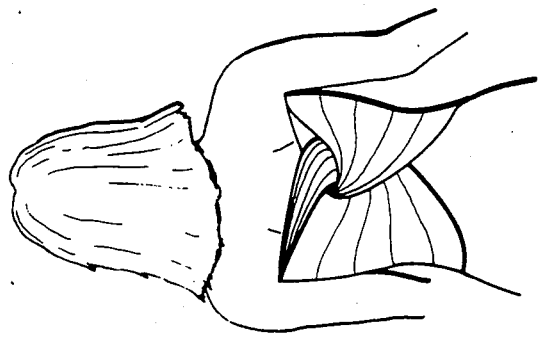
FIG. 4 is a rear view of FIG. 2 showing a single twist at the back.
Figure 3:
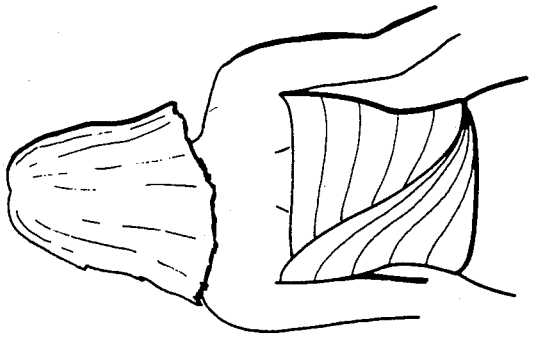
FIG. 3 is a rear view of FIG. 2.
Figure 2:
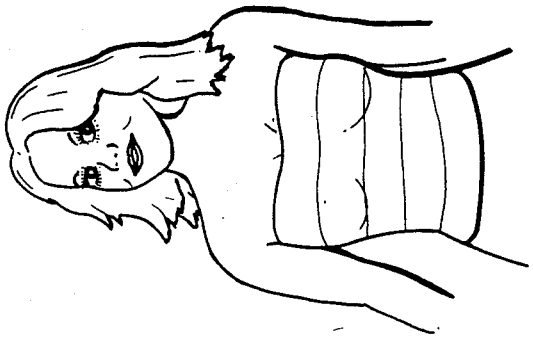
FIG. 2 is a front view of the invention in place on the wearer's upper torso, as worn in a double wrap.

In FIG. 2, the top is wrapped evenly over the bust twice, which may be accomplished as illustrated in FIG. 3, by simply alternating between inside and outside layers at the back or, as illustrated in FIG. 4, by simply twisting the tubular width before again slipping it over the head and the bust of the wearer.

Figure 5:
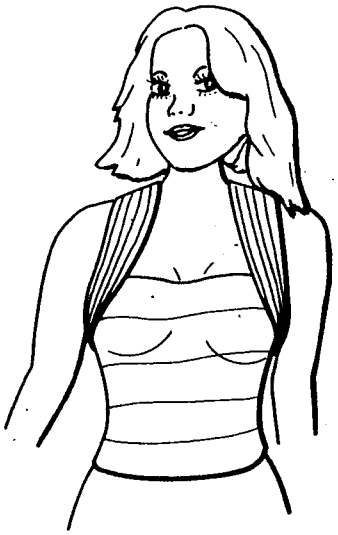
FIG. 5 is a frontal view of a further application of the inventive outer garment showing a wrap positioned over the neck of the wearer.

In FIG. 5, the top layer in the front is drawn under the arms and then over the nape of the neck.

Figure 6:
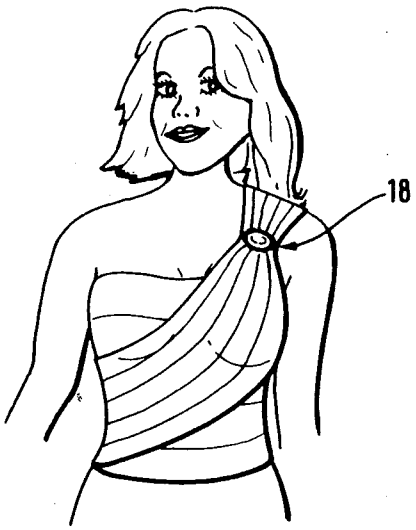
FIG. 6 is a frontal view of the invention as worn with a wrap over one shoulder.

In FIG. 6, the outside layer runs over the left shoulder instead of under the left arm as in FIG. 2 and may be gathered with a broach 18 or any suitable fastener at or on the shoulder.

Figure 7:
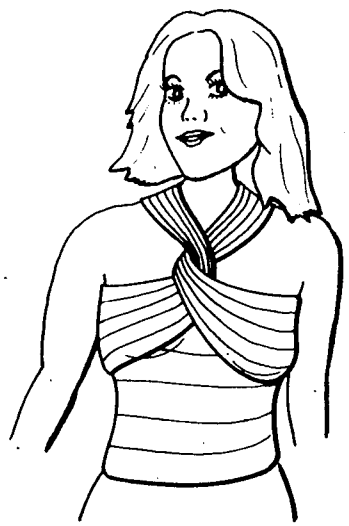
FIG. 7 is a frontal view of the invention as worn with a wrap looped over the head of the wearer.

FIG. 7 differs from FIG. 5 in that the outside layer is twisted once before it is drawn over the nape of the neck.

Figure 8:
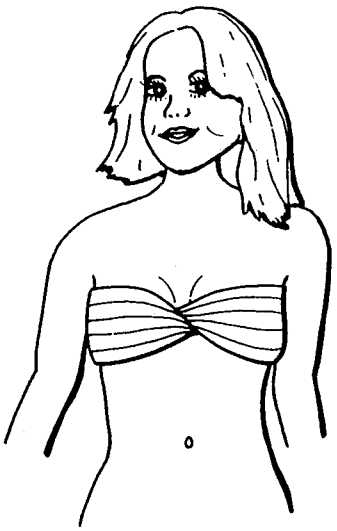
FIG. 8 is a frontal view of the invention as worn with a double wrap crossed on the bust of the wearer.

In FIG. 8, the top is worn as a brassiere, for which purpose the tube member is correspondingly gathered tightly and is twisted at the center of the breasts, whereby the outside and inside layers of the material are alternately exposed.

Figure 9:
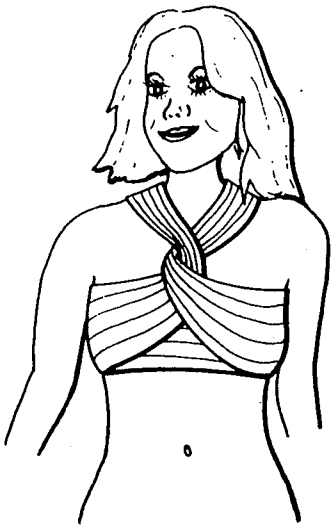
FIG. 9 is a frontal view of the inventive outer garment as shown in FIGS. 7 and 8 with the top wrap looped over the wearer's head and the bottom wrap gathered in the vicinity of the bust of the wearer.

FIG. 9 shows the same draping as in FIG. 7, except that the tube member has been doubled by gathering the inside layer over.

Instead of an already knitted tubular member of constant width, the tubular member can also, of course, be fabricated by sewing together the two ends of an unstretched piece of material adequate in length to form the tubular member described. The preferred embodiment, however, is the tube member described above since it is fabricated without a seam.

It will be readily apparent to those skilled in the art that many variations and modifications may be made from the above described example of a strapless outer garment for a woman. Such variations and modifications are included within the intended scope of the claims appended hereto.

What is claimed is:

1. An outer garment for wearing as a wrap around the upper torso of a female, said upper torso being of a first predetermined circumferential length, said outer garment comprising:

a fabric tube member having a first edge portion; a second edge portion substantially parallel to said first edge portion; and a body portion between said first and second edge portions defining a predetermined width, said body portion further having a second predetermined circumferential length in a direction transvers to said predetermined width, said second predetermined circumferential length of said body portion of said fabric tube member being at least approximately fifty percent (50%) greater than said first predetermined circumferential length of said upper torso, said fabric tube member further being stretchable in a direction parallel to said second predetermined circumferential length to at least approximately one hundred percent (100%) greater than said first predetermined circumferential length and comprising elasticity means at least along said direction transverse to said predetermined width such that said fabric tube member may be elastically deformed to a second predetermined length along said direction transverse to said predetermined width whereby said fabric tube member may be elastically deformed to wrap said upper torso of said female.

2. The outer garment as claimed in claim 1 wherein said second predetermined circumferential length is:

less than twice said first predetermined circumferential length such that said fabric tube fits snuggly when wrapped twice about said upper torso of said female.

3. The outer garment as claimed in claim 1, wherein said fabric tube further comprises:

an elastic member affixed along at least one of said first and second edge portions for holding said fabric tube along one of said first and second edge portions such that said fabric tube is held tightly about said upper torso of said female.

4. The outer garment as claimed in claim 3, wherein said elastic member comprises:

an elastic cord slidably attached to one of said first and second edge portions.

5. The outer garment as claimed in claim 1, wherein said elasticity means further comprises:

a wrap knitted material, said wrap knitted material being aligned for elastic deformation in said direction transverse to said predetermined width.

6. The outer garment as claimed in claim 1, wherein said elasticity means further comprises:

a weft-knitted material, said weft-knitted material being aligned for elastic deformation in said direction transverse to said predetermined width.

* * * * *

UNITED STATES PATENT AND TRADEMARK OFFICE

CERTIFICATE OF CORRECTION

PATENT NO. : 4,667,345

DATED : May 26, 1987

INVENTOR(S) : Ursula Jachowski

It is certified that error appears in the above-identified patent and that said Letters Patent is hereby corrected as shown below:

Column 3, line 22, delete "transvers" and insert ---- transverse ----.

Signed and Sealed this

Twenty-seventh Day of October, 1987

*Attest:*

DONALD J. QUIGG

*Attesting Officer*

*Commissioner of Patents and Trademarks*